US007403703B2

(12) United States Patent
Lamb

(10) Patent No.: US 7,403,703 B2
(45) Date of Patent: Jul. 22, 2008

(54) RADIANT ELECTRIC HEATER

(75) Inventor: Stuart Lamb, Redditch (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 10/542,286

(22) PCT Filed: Jan. 16, 2004

(86) PCT No.: PCT/GB2004/000119

§ 371 (c)(1),
(2), (4) Date: Mar. 29, 2006

(87) PCT Pub. No.: WO2004/066677

PCT Pub. Date: Aug. 5, 2004

(65) Prior Publication Data

US 2006/0186111 A1 Aug. 24, 2006

(30) Foreign Application Priority Data

Jan. 18, 2004 (GB) ..... 0301169.9

(51) Int. Cl.
*A45D 20/40* (2006.01)
*F24C 7/00* (2006.01)
*H05B 3/68* (2006.01)

(52) U.S. Cl. ..... 392/407; 219/460.1

(58) Field of Classification Search ..... None
See application file for complete search history.

(56) References Cited

U.S. PATENT DOCUMENTS 6,018,148 A * 1/2000 Wilkins ..... 219/461.1
6,034,358 A * 3/2000 Higgins ..... 219/462.1
6,376,810 B2 * 4/2002 Higgins ..... 219/448.11
7,132,626 B2 * 11/2006 Higgins et al. ..... 219/460.1

FOREIGN PATENT DOCUMENTS

| | | |
|---|---|---|
| DE | 3908600 | 9/1990 |
| EP | 0081073 | 10/1982 |
| EP | 0948238 | 10/1999 |
| EP | 0981263 | 2/2000 |
| WO | WO 2004066677 A1 * | 8/2004 |

OTHER PUBLICATIONS

Internation Search Report Apr. 28, 2004.

* cited by examiner

*Primary Examiner*—Thor S. Campbell
(74) *Attorney, Agent, or Firm*—Ira S. Dorman

(57) ABSTRACT

A radiant electric heater (2) comprises a base (8) of insulation material having a surface supporting at least one electric heating ribbon element (10) supported on edge. A rod-like temperature-responsive device (16) extends lengthwise partly across the heater (2) from an edge and over the at least one electric heating element (10). The surface of the base (8) is provided with an elongate recess (22) with sloping sides (24, 26) extending beneath and along the length of the temperature-responsive device (16). The ribbon (10) is supported in and traversing the elongate recess (22) such that an upper edge (28) of the ribbon (10) substantially follows a contour of the surface of the recess. The upper edge (28) of the ribbon (10) at a region (30) underlying the temperature-responsive device (16) is provided at a predetermined distance from the temperature-responsive device (16) and is at a lower level relative to the upper edge (28) of the ribbon (10) at regions at either side of the elongate recess (22).

17 Claims, 2 Drawing Sheets

RADIANT ELECTRIC HEATER

This invention relates to radiant electric heaters, for example for use in cooking appliances behind a sheet of material such as of glass-ceramic.

Radiant electric heaters are well known for use behind glass-ceramic cooking surfaces. Such heaters can comprise a dish-like support having therein a base layer of insulation material, such as microporous thermal and electrical insulation material. At least one electric heating element is provided, supported on the surface of the base layer. One form of heating element which has found wide acceptance is an elongate electrically conductive ribbon which is supported on edge and secured in the surface of the base layer.

It is known to provide a temperature-responsive device of rod-like form extending at least partly across the heater from an edge thereof and overlying the heating element or elements. Such temperature-responsive device operates to control the operation of the heater, such as to prevent the glass-ceramic material of the cooking surface reaching a high temperature at which damage would occur thereto.

It has been found advantageous to provide the temperature-responsive device of rod-like form with an outer tube of metal. Such a metal outer tube is more robust than outer tubes of quartz, fused silica or ceramic materials which were previously commonly used for rod-like temperature-responsive devices. However, a problem arises with the use of a metal, and hence electrically conductive, tube in close proximity to the heating element or elements. With outer tubes of quartz, fused silica or ceramic materials a metal termination or ferrule is generally known to be provided at a distal end thereof inside the heater. With such an arrangement it is readily straightforward to ensure adequate clearance between the metal termination or ferrule and the heating element or elements by providing a local region underlying the metal termination or ferrule which is free from heating element material. However, this is not possible with a temperature-responsive device having a full length metal outer tube and some means is therefore required to maintain a specified minimum electrical clearance between the metal tube and the one or more heating elements along the full length of the metal tube. The problem is exacerbated when the rod-like temperature-responsive device is only supported at a peripheral edge region of the heater, a distal free end region of the rod-like temperature-responsive device being unsupported at a central region within the heater. This means that, when the heater is subjected to mechanical shock, the free end of the rod-like temperature-responsive device may undergo displacement towards the heating element.

As a result of manufacturing tolerances, the rod-like temperature-responsive device when mounted on the heater may not be parallel to the base of the heater and such that the free end of the device is closer to the heating element than is the opposite end of the device.

Furthermore, in the case of a heater having a rod-like temperature-responsive device overlying a heating element or elements, a local increase in temperature may occur in those regions of the heating element or elements which lie directly beneath the rod-like temperature-responsive device. This can result in premature operation of the temperature-responsive device and may also contribute to premature failure of the heating element or elements. This problem has been addressed in GB-A-2340715 wherein the surface of the base of thermal insulation material supporting the heating element or elements is provided with a shallow recess beneath the rod-like temperature-responsive device. A ribbon-form heating element, which is partially embedded in the base, is partially embedded to a lesser extent in the shallow recess than in the surface of the base at either side of the recess. This results in a heating element which has a substantially planar upper surface and although it results in a lower temperature of the portion or portions of the heating element directly underlying the rod-like temperature-responsive device, it does not deal with the problem of ensuring satisfactory minimum clearance between the outer tube, particularly of metal, of the rod-like temperature-responsive device and the underlying heating element or elements.

It is an object of the present invention to overcome or minimise this problem.

According to the present invention there is provided a radiant electric heater comprising:

a base of thermal and electrical insulation material having a surface supporting at least one electric heating element comprising at least one elongate electrically conductive ribbon, the at least one electrically conductive ribbon being supported on edge;

a rod-like temperature-responsive device extending lengthwise partly across the heater from an edge thereof and over the at least one electric heating element;

the surface of the base being provided with an elongate recess with sloping sides extending beneath and along the length of the rod-like temperature-responsive device, the at least one electrically conductive ribbon being supported in and traversing the elongate recess such that an upper edge of the at least one electrically conductive ribbon substantially follows a contour of the surface of the recess and whereby the upper edge of the at least one electrically conductive ribbon at a region underlying the rod-like temperature-responsive device is provided at a predetermined distance from the rod-like temperature-responsive device and is at a lower level relative to the upper edge of the at least one electrically conductive ribbon at regions at either side of the elongate recess.

The rod-like temperature-responsive device may comprise metal and may comprise a metal tube.

The rod-like temperature-responsive device may have a first end supported at an edge region of the heater and a second end substantially unsupported at an inner region of the heater.

The elongate recess may have a depth which increases with increasing distance from the edge of the heater.

The elongate recess may also have a width which increases with increasing distance from the edge of the heater and may be such that a substantially constant angle of the sloping sides of the elongate recess is maintained as the depth of the elongate recess increases with increasing distance from the edge of the heater.

The elongate recess may be of substantially shell or scallop form.

The at least one electrically conductive ribbon may be of corrugated form and may be provided with a plurality of spaced-apart legs, integral with the at least one electrically conductive ribbon or secured thereto, the legs extending edgewise from the at least one electrically conductive ribbon and being at least partially embedded in the surface of the base. The legs may be partially embedded in the surface of the base to substantially the same depth in the elongate recess as elsewhere on the base.

The base may comprise microporous thermal and electrical insulation material and may be provided in a dish-like support, such as of metal.

The radiant electric heater may be adapted for location beneath a cooking surface, such as of glass-ceramic material.

By means of the present invention, the at least one electric heating element in the form of at least one electrically conductive ribbon is secured to and supported on the surface of the base such that it descends into the elongate recess on one sloping side thereof, passes underneath the rod-like temperature-responsive device at a predetermined distance therefrom, and then ascends from the elongate recess on the opposite sloping side thereof. Thus a required minimum electrical clearance is achieved between the at least one electrically conductive ribbon and the rod-like temperature-responsive device, which is essential when the device comprises metal. Furthermore, provision of increasing depth of the elongate recess with increasing distance from the edge of the heater enables the minimum required electrical clearance to be maintained if the rod-like temperature-responsive device is mounted on the heater sloping downwardly towards the base of the heater, or if the rod-like temperature-responsive device undergoes deflection in a direction towards the base of the heater, such as if the heater is subjected to mechanical shock conditions. Provision of increasing width of the elongate recess with increasing distance from the edge of the heater allows a substantially constant and suitably shallow angle of the sloping sides of the recess to be maintained, with the accompanying increase in depth of the recess with increasing distance from the edge of the heater, whereby descent and ascent of the at least one electrically conductive ribbon into and out of the recess is facilitated.

The arrangement of the present invention also minimises or reduces local increase in temperature of the at least one electrically conductive ribbon at a region or regions thereof directly underlying the rod-like temperature-responsive device.

For a better understanding of the present invention and to show more clearly how it may be carried into effect, reference will now be made by way of example to the accompanying drawings in which.

Figure 1:
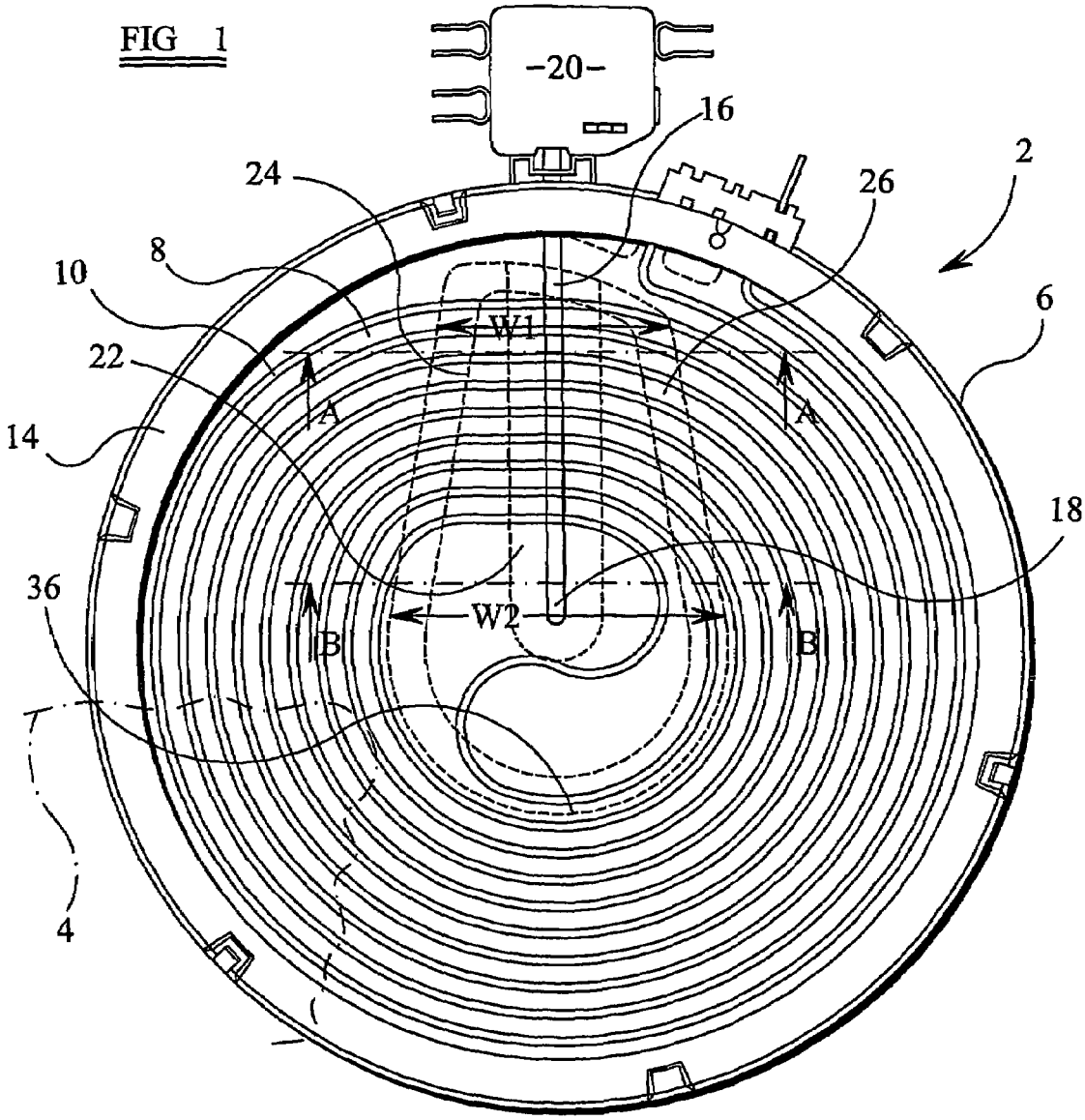
FIG. 1 is a plan view of an embodiment of a radiant electric heater according to the present invention.

A radiant electric heater 2, such as for use underneath a cooking surface 4, for example of glass-ceramic material, comprises a metal dish-like support 6 having therein a base layer 8 of thermal and electrical insulation material, such as microporous thermal and electrical insulation material. A radiant electric heating element is provided comprising an elongate corrugated electrically conductive ribbon 10, such as of iron-chromium-aluminum alloy, having spaced-apart legs 12 integral with or secured thereto and extending edgewise therefrom. The ribbon 10 is mounted edgewise on the base layer 8 and secured by at least partial embedding of the legs 12 in the surface of the base layer 8.

A peripheral wall 14 of insulation material is provided in the heater and has a top surface which may be arranged to contact a rear side of the cooking surface 4 in a cooking appliance.

A rod-like temperature-responsive device 16 is provided, comprising a metal outer tube and extending partly across the heater from an edge thereof. The rod-like temperature-responsive device 16 is supported at the edge of the heater and has a free end 18 which is unsupported at an inner region of the heater.

The rod-like temperature-responsive device 16 may comprise differentially-expanding components, which operate a switch means 20 provided at a periphery of the heater. Alternatively, the rod-like temperature-responsive device 16 may comprise a metal tube enclosing an electrical component (not shown) having an electrical parameter which changes with temperature. Such electrical component may be a resistance temperature detector, such as a platinum resistance temperature detector, whose electrical resistance changes as a function of temperature. The electrical component may be connected to external processing circuitry by means of lead wires passing through the metal tube of the device 16.

An elongate recess 22, with sloping sides 24, 26, is provided in the surface of the base layer 8. The elongate recess 22 extends radially from the edge of the heater and beneath and along the length of the rod-like temperature-responsive device 16. The electrically conductive ribbon 10 is arranged to be supported in and to traverse the elongate recess 22 such that an upper edge 28 of the ribbon 10 substantially follows a contour of the surface of the recess 22. The upper edge 28 of the ribbon 10 at a region 30 underlying the temperature-responsive device 16 is arranged at a predetermined distance from the temperature-responsive device 16 and is provided at a lower level relative to the upper edge 28 of the ribbon 10 at regions 32, 34 at either side of the recess 22.

The electrically conductive ribbon 10 is arranged with its legs 12 embedded in the base layer 8 to substantially the same extent in the elongate recess 22 as elsewhere in the base layer 8.

Figure 2:
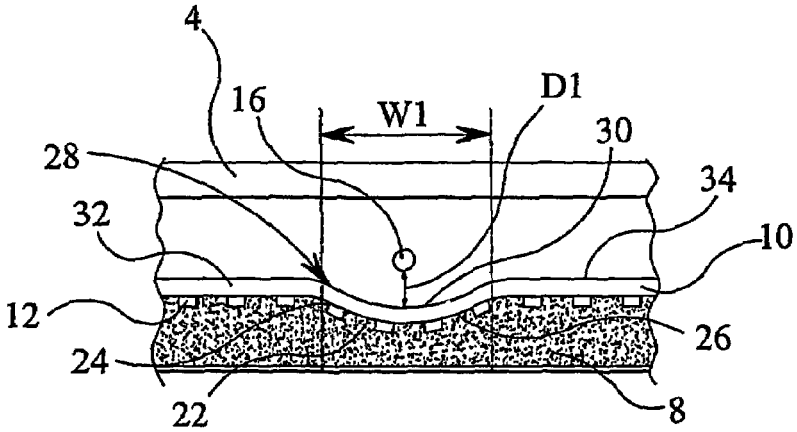
FIG. 2 is a section along line A-A of FIG. 1.
Figure 3:
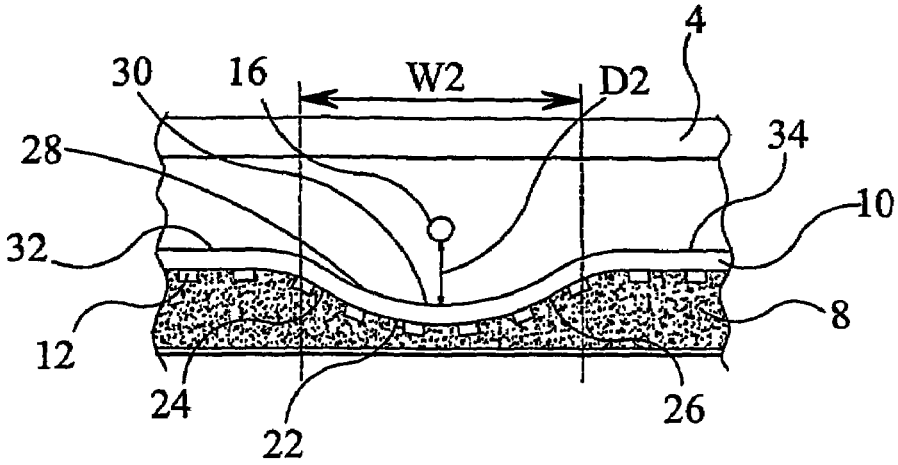
FIG. 3 is a section along line B-B of FIG. 1.
Figure 4:
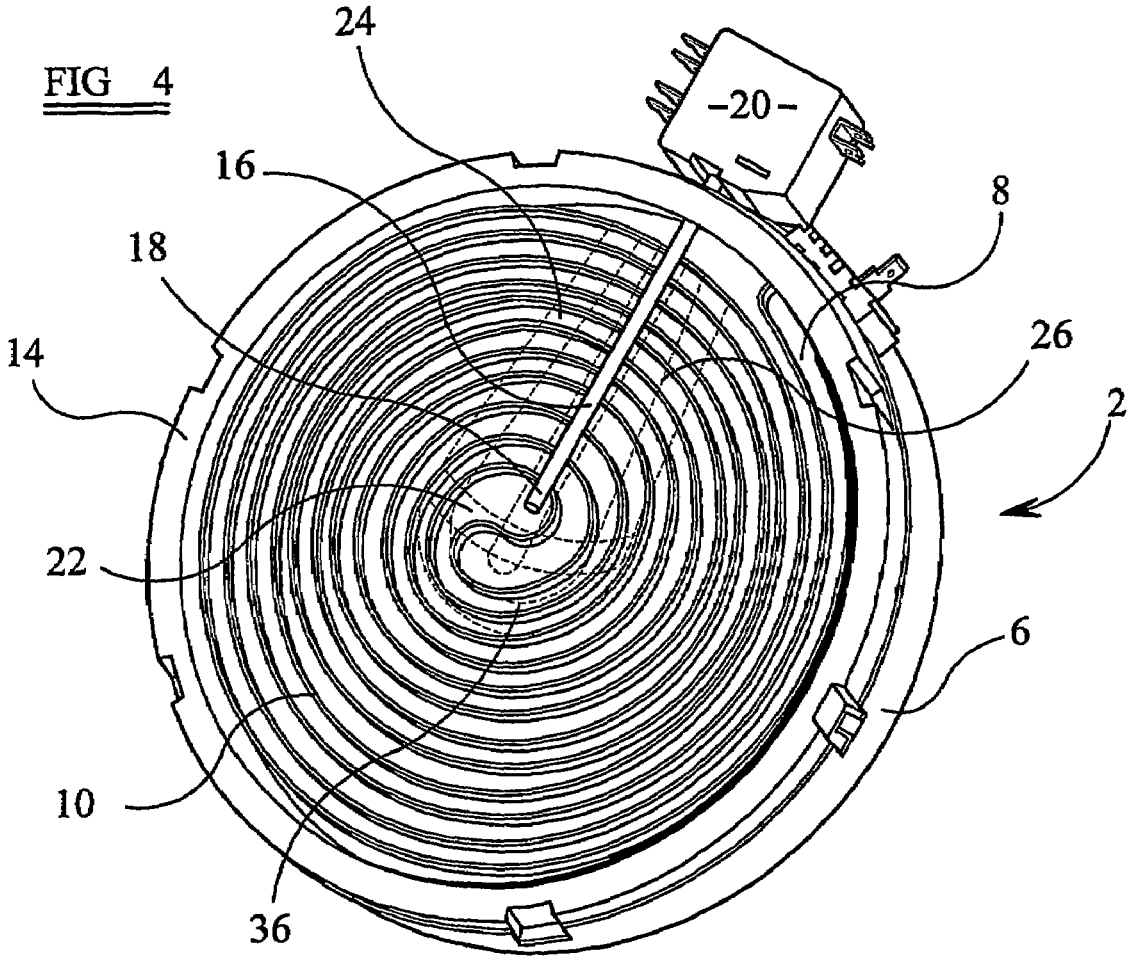
FIG. 4 is a perspective view of the radiant electric heater of FIG. 1.

As shown particularly in FIGS. 2 and 3, the electrically conductive ribbon 10, supported on and secured to the base layer 8, descends into the recess 22 on one sloping side 24 thereof, passes with predetermined clearance underneath the rod-like temperature-responsive device 16, and then ascends from the recess 22 on the opposite sloping side 26 thereof. The angle and dimensions of the sloping sides 24, 26 of the recess 22 are selected in accordance with a depth required for the recess 22 and to facilitate turning of the ribbon 10 into and out of the recess 22.

The free end 18 of the rod-like temperature-responsive device 16 may undergo displacement in a direction towards the base layer 8 in the event that the heater 2 is subjected to mechanical shock load conditions.

Alternatively, or additionally, the rod-like temperature-responsive device 16 when mounted on the heater may not be parallel to the surface of the base layer 8, due to manufacturing tolerances, and such that it slopes downwardly towards the base 8. In order to ensure that a predetermined minimum electrical clearance exists between the temperature-responsive device 16 and the ribbon 10 at all times, under all conditions, it is arranged for greater clearance to be provided between the ribbon 10 and the rod-like temperature-responsive device 16 at the free end region 18 of the temperature-responsive device 16 than at the end thereof near the edge of the heater. For this purpose, the elongate recess 22 is arranged, such as by being ramped, to have a depth which gradually increases with increasing distance from the edge of the heater. This is particularly illustrated in FIGS. 2 and 3. FIG. 2 represents a cross-sectional view of the heater 2 at a region near the edge of the heater, while FIG. 3 represents a cross-sectional view of the heater 2 at an inner region of the heater, near the free end 18 of the rod-like temperature-responsive device 16. As shown in FIG. 2, a distance D1 is provided between the region 30 of the upper edge 28 of the ribbon 10 and the rod-like temperature-responsive device 16 at the region of the heater near the peripheral edge thereof. As shown in FIG. 3, a distance D2, which is greater than the distance D1 of FIG. 2, is provided between the region 30 of the upper edge 28 of the ribbon 10 and the temperature-responsive device 16, at the inner region of the heater near the free end 18 of the rod-like temperature-responsive device 16.

In order to maintain a substantially constant angle of slope of the sloping sides 24, 26 of the recess 22, while accommodating the gradually increasing depth of the recess 22 with increasing distance from the edge of the heater, it is suitably arranged for the recess 22 to gradually increase in width with increasing distance from the edge of the heater. Accordingly, the width W1 of the recess 22 at a region near the edge of the heater is made less than the width W2 at an inner region of the heater near the free end 18 of the temperature-responsive device 16. The recess 22 is therefore arranged to taper in width as well as being ramped in depth and the resulting form thereof is substantially that of a shell or scallop.

An end region 36 of the elongate recess 22 may terminate in any desired form, such as a wall form, or be of stepped or sloping form.

The arrangement of the recess 22 and the rod-like temperature-responsive device 16 is further advantageous in that it minimises or reduces any tendency for the ribbon-form heating element 10 to operate with a higher temperature in the region directly beneath the rod-like temperature-responsive device 16, compared with regions elsewhere in the heater.

The invention claimed is:

1. A radiant electric heater (2) comprising: a base (8) of thermal and electrical insulation material having a surface supporting at least one electric heating element comprising at least one elongate electrically conductive ribbon (10), the at least one electrically conductive ribbon (10) being supported on edge; a rod-like temperature-responsive device (16) extending lengthwise partly across the heater (2) from an edge thereof and over the at least one electric heating element (10); the surface of the base (8) being provided with an elongate recess (22) with sloping sides (24, 26) extending beneath and along the length of the rod-like temperature-responsive device (16), wherein the elongate recess has a width which increases with increasing distance from the edge of the heater, and wherein the at least one electrically conductive ribbon (10) is supported in and traverses the elongate recess (22) such that an upper edge (28) of the at least one electrically conductive ribbon (10) substantially follows a contour of the surface of the recess and whereby the upper edge (28) of the at least one electrically conductive ribbon (10) at a region (30) underlying the rod-like temperature-responsive device (16) is provided at a predetermined distance from the rod-like temperature-responsive device (16) and is at a lower level relative to the upper edge (28) of the at least one electrically conductive ribbon (10) at regions (32, 34) at either side of the elongate recess (22), the at least one electrically conductive ribbon (10) in the regions (32, 34) at either side of the elongate recess (22) being provided on a substantially planar surface of the base.

2. A heater as claimed in claim 1, wherein the rod-like temperature-responsive device (16) comprises metal.

3. A heater as claimed in claim 1, wherein the rod-like temperature-responsive device (16) comprises a metal tube.

4. A heater as claimed in claim 1, wherein the rod-like temperature-responsive device (16) has a first end supported at an edge region of the heater (2) and a second end (18) substantially unsupported at an inner region of the heater (2).

5. A heater as claimed in claim 1, wherein the elongate recess (22) has a depth which increases with increasing distance from the edge of the heater (2).

6. A heater as claimed in claim 5, wherein a substantially constant angle of the sloping sides (24, 26) of the elongate recess (22) is maintained as the depth of the elongate recess (22) increases with increasing distance from the edge of the heater (2).

7. A heater as claimed in claim 1, wherein the elongate recess (22) is of a form selected from substantially shell and scallop form.

8. A heater as claimed in claim 1, wherein the at least one electrically conductive ribbon (10) is of corrugated form.

9. A heater as claimed in claim 1, wherein the at least one electrically conductive ribbon (10) is provided with a plurality of spaced-apart legs (12), the legs (12) extending edgewise from the at least one electrically conductive ribbon (10) and being at least partially embedded in the surface of the base (8).

10. A heater as claimed in claim 9, wherein the legs (12) are integral with the at least one electrically conductive ribbon (10).

11. A heater as claimed in claim 9, wherein the legs (12) are secured to the at least one electrically conductive ribbon (10).

12. A heater as claimed in claim 9, wherein the legs (12) are partially embedded in the surface of the base (8) to substantially the same depth in the elongate recess (22) as elsewhere on the base (8).

13. A heater as claimed in claim 1, wherein the base (8) comprises microporous thermal and electrical insulation material.

14. A heater as claimed in claim 1, wherein the base (8) is provided in a dish-like support (6).

15. A heater as claimed in claim 14, wherein the dish-like support (6) is of metal.

16. A heater as claimed in claim 1, wherein the heater is adapted for location beneath a cooking surface (4).

17. A heater as claimed in claim 16, wherein the cooking surface (4) is of glass-ceramic material.

* * * * *